US010141086B2

(12) United States Patent
Cases et al.

(10) Patent No.: US 10,141,086 B2
(45) Date of Patent: Nov. 27, 2018

(54) CABLE FOR HIGH SPEED DATA COMMUNICATIONS

(75) Inventors: Moises Cases, Austin, TX (US); Vinh B. Lu, Austin, TX (US); Bhyrav M. Mutnury, Austin, TX (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 2017 days.

(21) Appl. No.: 12/628,245

(22) Filed: Dec. 1, 2009

(65) Prior Publication Data

US 2011/0127062 A1 Jun. 2, 2011

(51) Int. Cl.

| | |
|---|---|
| ***H01B 7/00*** | (2006.01) |
| ***H01B 11/20*** | (2006.01) |
| ***H01B 11/10*** | (2006.01) |
| ***H01P 3/06*** | (2006.01) |

(52) U.S. Cl.

CPC ..... *H01B 11/20* (2013.01); *H01B 11/1016* (2013.01); *H01P 3/06* (2013.01); *H01B 11/1091* (2013.01); *Y10T 29/49117* (2015.01)

(58) Field of Classification Search

USPC ..... 174/110 R, 113 R, 113 C, 108, 109, 174/102 R, 117 R, 117 F, 117 FF

See application file for complete search history.

(56) References Cited

U.S. PATENT DOCUMENTS 2,391,037 A * 12/1945 Shafer, Jr. ..... 174/102 SP
3,439,111 A * 4/1969 Miracle et al. ..... 174/107
4,096,346 A * 6/1978 Stine et al. ..... 174/36
4,737,598 A * 4/1988 O'Connor ..... B32B 15/08 174/115
4,912,283 A * 3/1990 O'Connor ..... 174/36
5,144,098 A * 9/1992 VanDeusen ..... H01B 11/10 174/102 SC
5,216,202 A 6/1993 Yoshida et al.
5,416,268 A * 5/1995 Ellis ..... 174/36
5,486,649 A * 1/1996 Gareis ..... H01B 11/1091 174/10
5,521,331 A 5/1996 Hillburn
5,956,445 A * 9/1999 Deitz et al. ..... 385/100
(Continued)

OTHER PUBLICATIONS

Griffith, et al.; Surface Transfer Impedance of Cable Shields Having a Longitudinal Seam; IEEE Transactions on Communication Technology; Aug. 1971; pp. 517-522; vol. COM-19, No. 4; IEEE; Chicago IL.

*Primary Examiner* — William H Mayo, III
(74) *Attorney, Agent, or Firm* — Brandon C. Kennedy; Jason A. Friday; Kennedy Lenart Spraggins LLP

(57) ABSTRACT

A cable for high speed data communications is provided. The cable includes a first inner conductor enclosed by a first dielectric layer and a second inner conductor enclosed by a second dielectric layer. The first inner conductor is substantially parallel to the second inner conductor and to a longitudinal axis. The cable includes a conductive shield wrapped around the first and second inner conductors, with an overlap of the conductive shield along and about the longitudinal axis. The overlap is aligned with a low current plane. The low current plane is substantially parallel to the first and second inner conductors, substantially equidistant from the first and second inner conductors, and substantially orthogonal to a plane including the first and second inner conductors.

12 Claims, 6 Drawing Sheets

(56) References Cited

U.S. PATENT DOCUMENTS

| | | | | |
|---|---|---|---|---|
| 6,201,190 | B1 | 3/2001 | Pope | |
| 6,259,019 | B1 * | 7/2001 | Damilo | H01B 13/262 174/102 R |
| 6,288,328 | B1 | 9/2001 | Brake et al. | |
| 6,403,887 | B1 * | 6/2002 | Kebabjian et al. | 174/110 R |
| 6,444,902 | B1 * | 9/2002 | Tsao et al. | 174/36 |
| 6,624,359 | B2 * | 9/2003 | Bahlmann et al. | 174/113 C |
| 6,677,518 | B2 * | 1/2004 | Hirakawa et al. | 174/36 |
| 6,803,518 | B2 * | 10/2004 | Chang | 174/36 |
| 6,815,611 | B1 * | 11/2004 | Gareis | 174/36 |
| 7,205,479 | B2 * | 4/2007 | Caveney | 174/110 R |
| 7,479,601 | B1 * | 1/2009 | Cases et al. | 174/102 R |
| 2004/0026101 | A1 * | 2/2004 | Ochi | 174/36 |
| 2008/0164060 | A1 | 7/2008 | Burland | |
| 2008/0308293 | A1 | 12/2008 | Archambeault et al. | |

* cited by examiner

CABLE FOR HIGH SPEED DATA COMMUNICATIONS

BACKGROUND OF THE INVENTION

Field of the Invention

The field of the invention is data processing, or, more specifically, a cable for high speed data communications, methods for manufacturing a cable for high speed data communications and methods for transmitting a signal on a cable for high speed data communications.

Description of Related Art

High speed data communications over shielded cables are an important component to large high-end servers and digital communications systems. While optical cables provide long distance drive capability, copper cables are typically preferred in environments that require a shorter distance cable due to a significant cost savings opportunity. A typical copper cable used in environments requiring a shorter distance cable, is a twinaxial cable. A twinaxial cable is a coaxial cable that includes two insulated, inner conductors and a shield wrapped around the insulated inner conductors. Twinaxial cables are used for half-duplex, balanced transmission, high-speed data communications. In current art however, twinaxial cables used in data communications environments are limited in performance due to a bandstop effect.

For further explanation of typical twinaxial cables, therefore, FIG. 1 sets forth a perspective view of a typical twinaxial cable (100). The exemplary typical twinaxial cable (100) of FIG. 1 includes two conductors (106, 108) and two dielectrics (110, 112) surrounding the conductors. The conductors (106, 108) and the dielectrics (110, 112) are generally parallel to each other and a longitudinal axis (105).

The typical twinaxial cable (100) of FIG. 1 also includes a shield (114). The shield, when wrapped around the conductors of a cable, acts as a Faraday cage to reduce electrical noise from affecting signals transmitted on the cable and to reduce electromagnetic radiation from the cable that may interfere with other electrical devices. The shield also minimizes capacitively coupled noise from other electrical sources, such as nearby cables carrying electrical signals. The shield (114) is wrapped around the conductors (106, 108). The shield (114) includes wraps (101-103) along and about the longitudinal axis (105), each wrap overlapping the previous wrap. A wrap is a 360 degree turn of the shield around the longitudinal axis (105). The typical twinaxial cable of FIG. 1 includes three wraps (101-103), but readers of skill in the art will recognize that the shield may be wrapped around the inner conductors and the dielectric layers any number of times in dependence upon the length of the cable. Wrap (101) is shaded for purposes of explanation. Each wrap (101-103) overlaps the previous wrap. That is, wrap (101) is overlapped by wrap (102) and wrap (102) is overlapped by wrap (103). The overlap (104) created by the overlapped wraps is continuous along and about the longitudinal axis (105) of the cable (100).

The wraps (101-103) of the shield (114) create an overlap (104) of the shield that forms an electromagnetic bandgap structure ('EBG structure') that acts as the bandstop filter. An EBG structure is a periodic structure in which propagation of electromagnetic waves is not allowed within a stopband. A stopband is a range of frequencies in which a cable attenuates a signal. In the cable of FIG. 1, when the conductors (106, 108) carry current from a source to a load, part of the current is returned on the shield (114). Due to skin effect, the current in the conductors to the load displaces on the outer surface of the conductor, and the current return path attempts to run parallel to, but in the opposite direction of, the current to the load. As such, the current on the shield (114) encounters the overlap (104) of the shield (104) periodically and a discontinuity exists in the current return path due to the overlap. The discontinuity in the current return path at the overlap (104) created by the wraps (101-103) acts as a bandstop filter that attenuates signals at frequencies in a stopband.

For further explanation, therefore, FIG. 2 sets forth a graph of the insertion loss of a typical twinaxial cable. Insertion loss is the signal loss in a cable that results from inserting the cable between a source and a load. The insertion loss depicted in the graph of FIG. 2 is the insertion loss of a typical twinaxial cable, such as the twinaxial cable described above with respect to FIG. 1. In the graph of FIG. 2, the signal (119) is attenuated (118) within a stopband (120) of frequencies (116) ranging from seven to nine gigahertz ('GHz'). The stopband (120) has a center frequency (121) that varies in dependence upon the composition of the shield, the width of the shield, and the rate that the shield is wrapped around the conductors and dielectrics. The center frequency (121) of FIG. 2 is 8 GHz.

The attenuation (118) of the signal (119) in FIG. 2 peaks at approximately −60 decibels ('dB') for signals with frequencies (116) in the range of approximately 8 GHz. The magnitude of the attenuation (118) of the signal (119) is dependent upon the length of the cable. The effect of the EBG structure, the attenuation of a signal, increases as the length of the EBG structure increases. A longer cable having a wrapped shield has a longer EBG structure and, therefore, a greater attenuation on a signal than a shorter cable having a shield wrapped at the same rate. That is, the longer the cable, the greater the attenuation of the signal. In addition to signal attenuation, the bandstop effect also increases other parasitic effects in the cable, such as jitter and the like.

Typical twinaxial cables for high speed data communications, therefore, have certain drawbacks. Typical twinaxial cables have a bandstop filter created by overlapped wraps of a shield that attenuates signals at frequencies in a stopband. The attenuation of the signal increases as the length of the cable increases. The attenuation limits data communications at frequencies in the stopband.

SUMMARY OF THE INVENTION

Cables for high speed data communications, methods of manufacturing such cables, and methods for transmitting a signal on such cables are disclosed. The cables include a first inner conductor enclosed by a first dielectric layer and a second inner conductor enclosed by a second dielectric layer, the first inner conductor substantially parallel to the second inner conductor and to a longitudinal axis; and a conductive shield wrapped around the first and second inner conductors, including an overlap of the conductive shield along and about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 3:
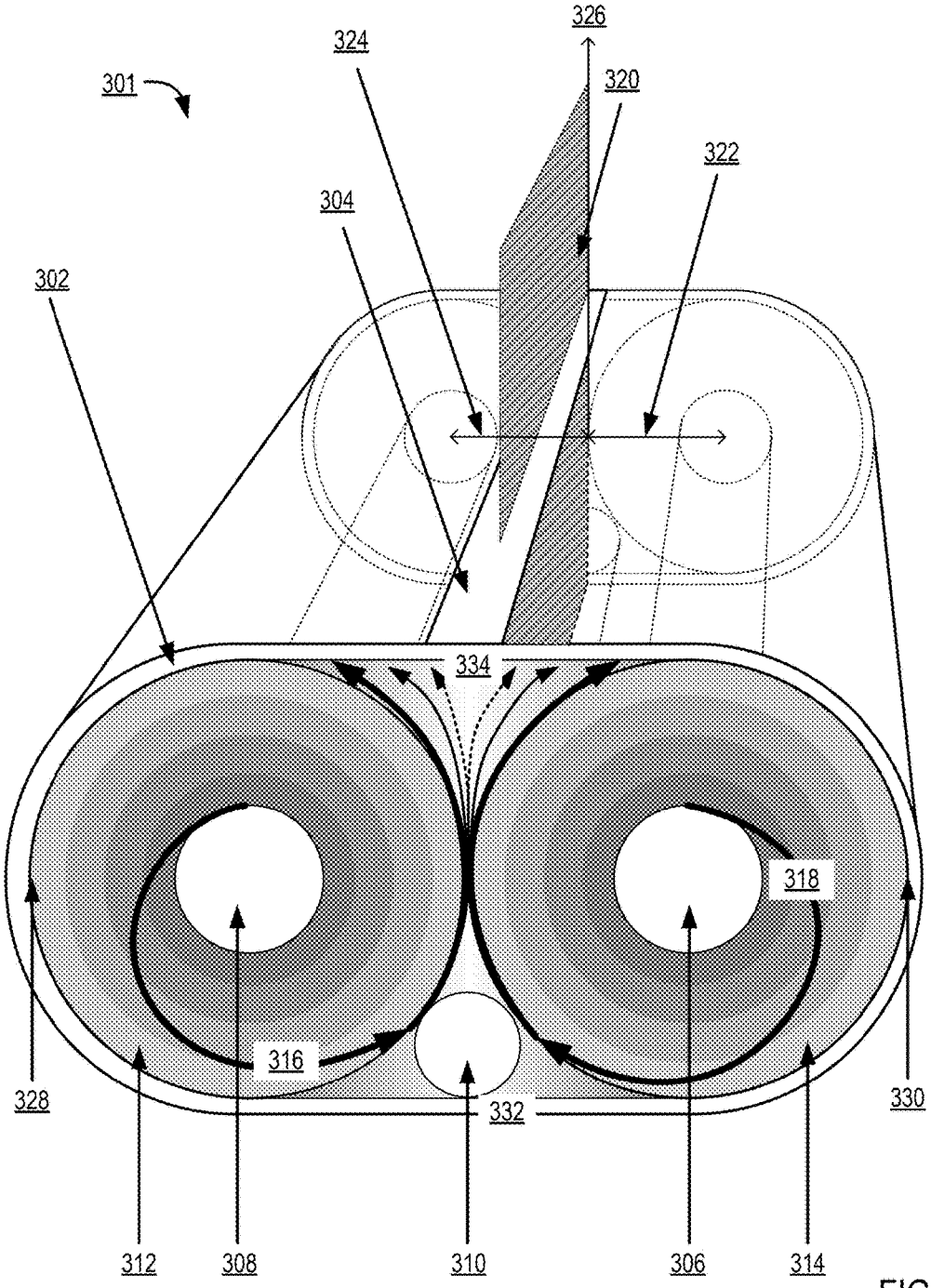
FIG. 3 sets forth a perspective view of a data communications cable for high speed data communications according to embodiments of the present invention.

Exemplary cables and methods of manufacturing cables for high speed data communications in accordance with embodiments of the present invention are described with reference to the accompanying drawings, beginning with FIG. 3. FIG. 3 sets forth a perspective view of a data communications cable (301) for high speed data communications according to embodiments of the present invention.

The cable (301) of FIG. 3 includes a first inner conductor (308) enclosed by a first dielectric layer (312) and a second inner conductor (306) enclosed by a second dielectric layer (314). The first inner conductor (308) is substantially parallel to the second inner conductor (306). The first and second inner conductors (308, 306) are also substantially parallel to a longitudinal axis (depicted in FIG. 4). Although the cable (301) is described here as including only two inner conductors, readers of skill in the art will immediately recognize that cables for high speed data communications according to embodiments of the present invention may include any number of inner conductors.

The cable of FIG. 3 also includes an optional drain conductor (310). A drain conductor is a non-insulated conductor electrically connected to the earth potential ('ground') and typically electrically connected to conductive shield (302) also referred to here as the 'conductive shield material (302).' Two inner conductors and a drain are depicted in the example cable (301) of FIG. 3 for clarity only, not limitation. Readers of skill in the art will immediately recognize that cables configured according to embodiments of the present invention for high speed data communications may include any number of inner conductors as well as no drain at all.

The cable (301) of FIG. 3 also includes a conductive shield (302) wrapped around the first and second inner conductors (308,306). The conductive shield (302) is wrapped to create an overlap (304) along and about the longitudinal axis—substantially parallel to inner conductors. The overlap (304) is aligned with a low current plane (320). The low current plane (320) of FIG. 3 is substantially parallel to the first and second inner conductors (306, 308). The low current plane (320) is also substantially equidistant from the first and second inner conductors (306, 308). That is, the distance (324) from the center of the first inner conductor (308) to the low current plane (320) and the distance (322) from the center of the second inner conductor (306) to the low current plane (320) is substantially equal. The low current plane is also substantially orthogonal to a plane including the first and second inner conductors (308, 306). In the example of FIG. 3, the axis (326) of the low current plane (320) is depicted as substantially orthogonal to the arrows depicting distance from the center of the inner conductors to the low current plane.

The plane (320) is described here as 'low current' due to the current distribution throughout the cable (301). In FIG. 3, current (316) distribution generated by signals carried on the first inner conductor (308) generally rotates counterclockwise. The current (318) distribution generated by signals carried on the second inner conductor (306) generally rotates clockwise. Current distribution is strongest at the inner conductors and weakens at distances farther away from the inner conductors. Along the low current plane (320), however, there is little to no current distribution. That is, current distribution in the cable spreads to the sides (328, 330) of the cable (301), but is significantly reduced along the top (334) and bottom (332) of the cable (301). The current distribution is typically the weakest at the low current plane (320), equidistant from the centers of the inner conductors. The gradual decrease of current distribution is depicted in the example cable (301) of FIG. 3 by shading around the inner conductors—darkest shading representing the greatest strength in distribution. The gradual decrease of current distribution is also depicted in FIG. 3 by the arrows of current distribution which decrease in weight to a dotted arrow. In the example of FIG. 3, there is no current distribution at the top (334) of the cable (301) in the low current plane (320) and no current distribution at the bottom (332) of the cable (301) in low current plane (320).

Figure 1:
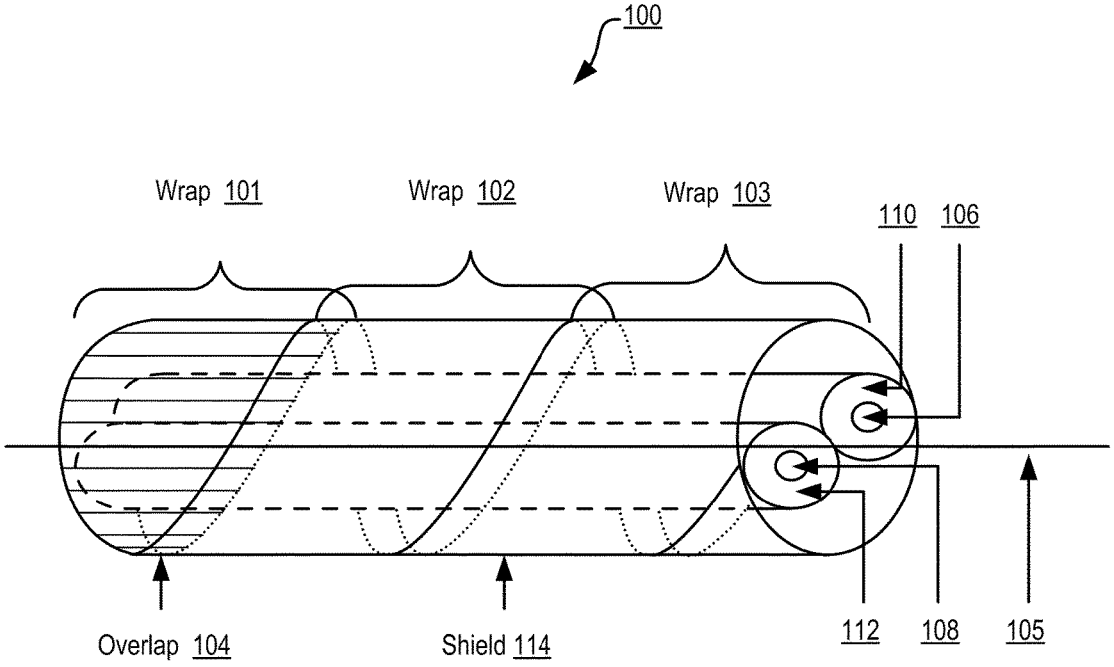
PRIOR ART FIG. 1
FIG. 1 sets forth a perspective view of a typical twinaxial cable.
Figure 2:
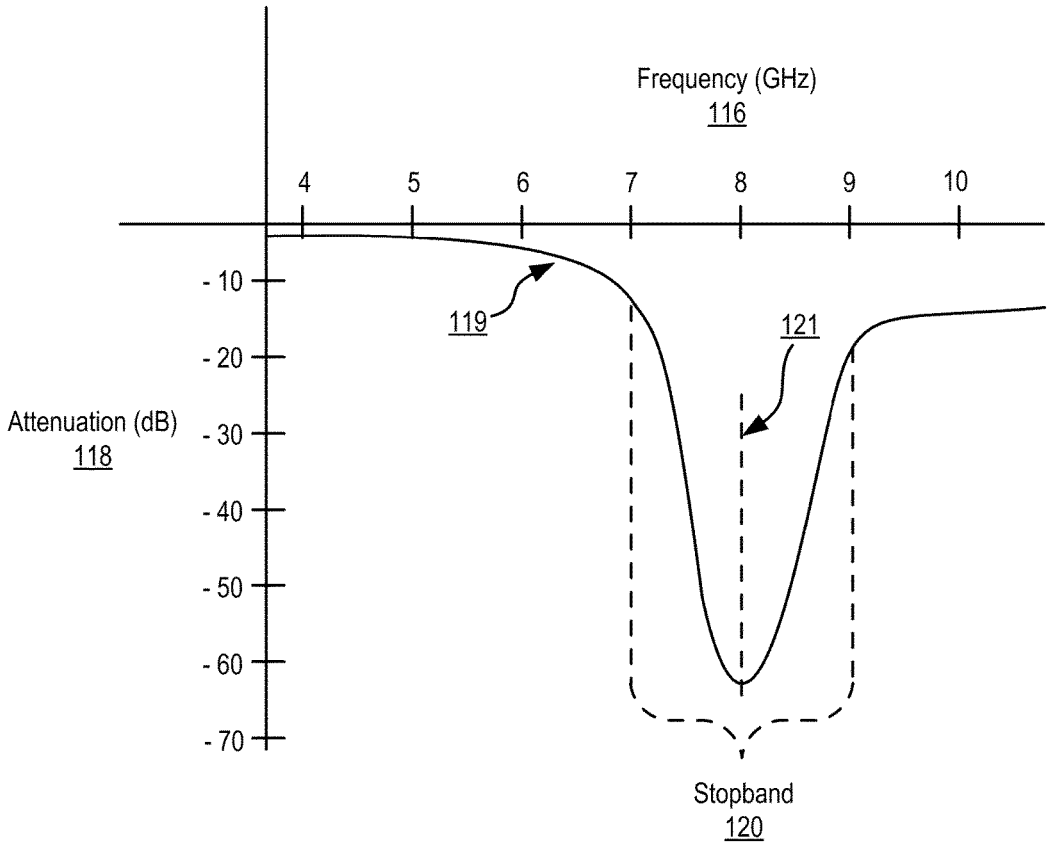
PRIOR ART FIG. 2
FIG. 2 sets forth a graph of the insertion loss of a typical twinaxial cable.

In many cables, overlapping the shield (302) longitudinally rather than horizontally as in FIG. 1 would increase effect of the bandstop. In FIG. 3, however, the overlap (304) occurs along the low current plane (320), that is, in a region of little to no current distribution. The longitudinal overlap (304) therefore does not increase the effect of the bandstop. Instead, the longitudinal wrap increases the center frequency of the bandstop filter in comparison to the center the frequency of a horizontally wrapped cable. The stopband filter may effectively be tuned by the longitudinal overlap (304) to filter frequencies greater than those to be transmitted along the cable. That is, the overlap (304) in the example of FIG. 3 produces a stopband filter that filters frequencies in a stopband, where that stopband includes frequencies greater than frequencies of signals to be transmitted along the first and second inner conductors. In one embodiment, the cable (301) of FIG. 3 is configured with a longitudinal overlap (304) of a conductive shield (302) that produces stopband that includes frequencies greater than frequencies in the range of 5-10 gigahertz.

In the example cable (301) of FIG. 3, the conductive shield (302) may be an aluminum foil shield. Although the conductive shield (302) is described as aluminum foil, those of skill in the art will recognize that conductive shield (302) may be any conductive material capable of being wrapped around the inner conductors of a cable, such as copper or gold.

Figure 4:
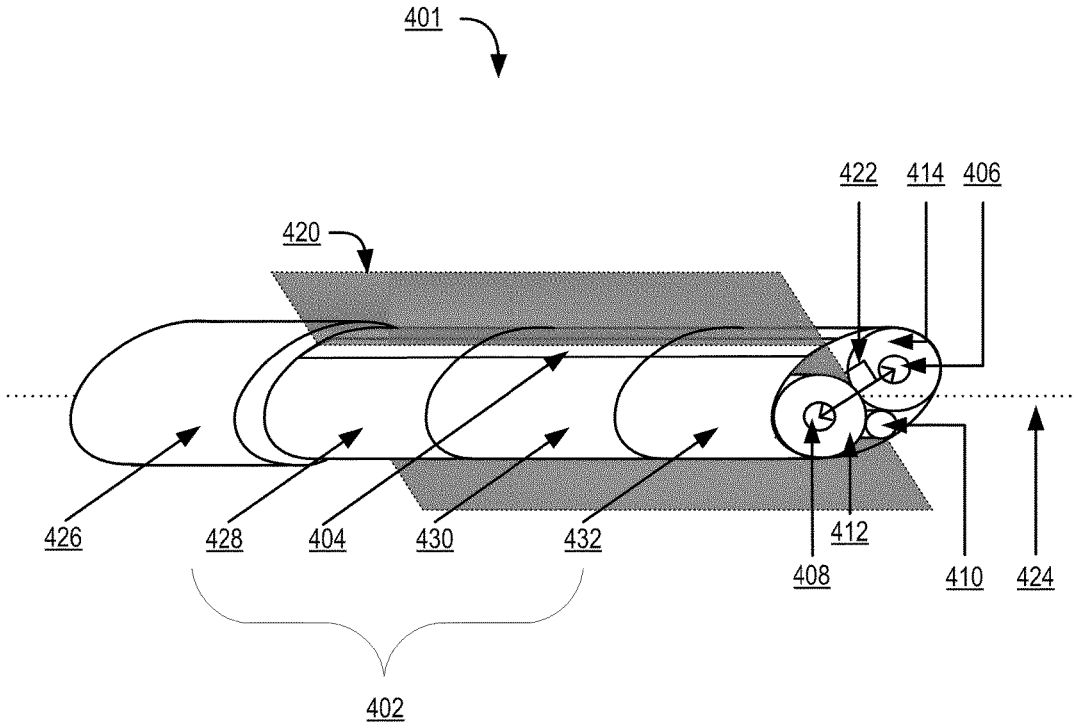
FIG. 4 sets forth another perspective view of a data communications cable for high speed data communications according to embodiments of the present invention.

FIG. 4 sets forth another perspective view of a data communications cable (401) for high speed data communications according to embodiments of the present invention. The cable (401) of FIG. 4 is similar to the cable (301) of FIG. 3, including a first inner conductor (408) enclosed by a first dielectric layer (412) and a second inner conductor (406) enclosed by a second dielectric layer (414). The first inner conductor (408) is substantially parallel to the second inner conductor (406). The first and second inner conductors (408, 406) are also substantially parallel to a longitudinal axis (424).

The cable of FIG. 4 also includes an optional drain conductor (410) and a conductive shield (402) wrapped around the first and second inner conductors (408,406). The conductive shield (402) is wrapped to create an overlap (404) along and about the longitudinal axis (424)—substantially parallel to inner conductors. The overlap (404) is aligned with a low current plane (420). The low current plane (420) of FIG. 4 is substantially parallel to the first and second inner conductors (406,408). The low current plane (420) is also substantially equidistant from the first and second inner conductors (406, 408). The low current plane is also substantially orthogonal to a plane including the first and second inner conductors (408,406). In the example of FIG. 4, the low current plane (420) is depicted as substantially orthogonal to the arrows depicting distance from the center of the inner conductors to the low current plane by the 90 degree angle (422).

The cable (401) of FIG. 4 differs from the cable (301) of FIG. 3, however, in that the in the example cable (401) of FIG. 4, the first and second inner conductors (408,406) are substantially the same length and corresponding ends of the first and second inner conductors are aligned. The cable (401) may also include any number of conductive shields (402), in this example three (428,430,432), wrapped around the first and second inner conductors. Each of the conductive shields (428,430,432) is overlapped along and about the longitudinal axis (424). The overlaps (404) of the conductive shields (428,438,432) are aligned with the low current plane (420). The conductive shields (408, 410, 412) are wrapped along the first and second inner conductors (408,406) iteratively beginning at one end of the first and second inner conductors (408,406) and ending at the other end of the first and second inner conductors (408,406).

The cable (401) of FIG. 4 also includes a non-conductive layer (426) enclosing the conductive shield (402) and the first and second inner conductors (408,406). In this example, the non-conductive layer (426) encloses the drain (410), the first dielectric material (412), and the second dielectric material (414) as well as the conductive shield (402) and the first and second inner conductors (408,406). The non-conductive layer (426) is depicted as enclosing only a portion of the cable (401) for clarity of explanation only, not for limitation. Readers of skill in the art will immediately recognize that a non-conductive layer (426) enclosing cables for high speed data communications in accordance with embodiments of the present invention may enclose any portion or all of such a cable.

Figure 5:
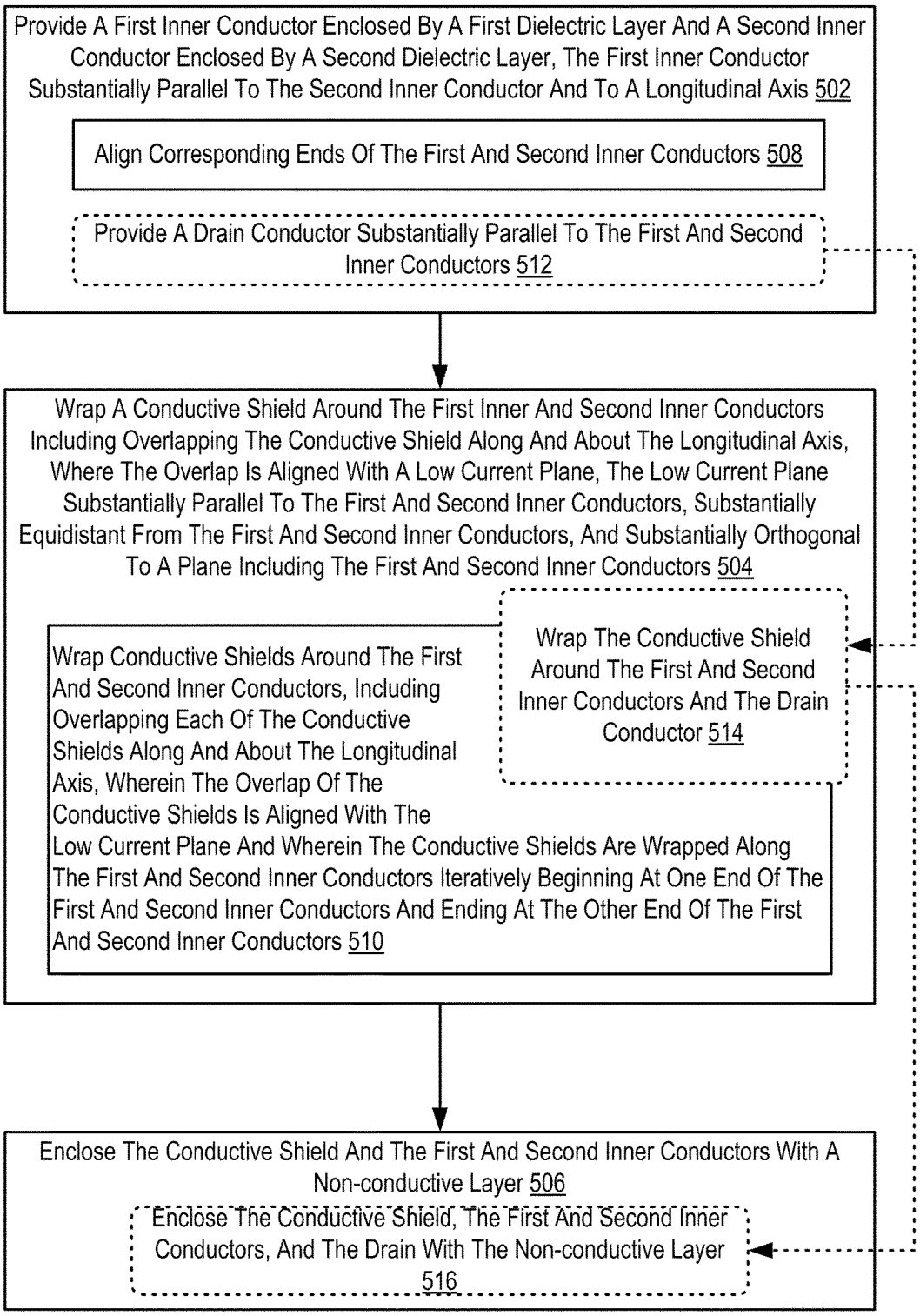
FIG. 5 sets forth a flow chart illustrating an exemplary method for manufacturing a cable for high speed data communications according to embodiments of the present invention.

For further explanation FIG. 5 sets forth a flow chart illustrating an exemplary method of manufacturing a cable for high speed data communications according to embodiments of the present invention. The method of FIG. 5 includes providing (502) a first inner conductor enclosed by a first dielectric layer and a second inner conductor enclosed by a second dielectric layer. The first inner conductor may be substantially parallel to the second inner conductor and to a longitudinal axis.

The method of FIG. 5 also includes wrapping (504) a conductive shield around the first and second inner conductors, including overlapping the conductive shield along and about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors. In the method of claim 5, the overlap produces a stopband filter that filters frequencies in a stopband where the stopband includes frequencies greater than frequencies of signals to be transmitted along the first and second inner conductors. In some embodiments, the stopband includes frequencies greater than frequencies in the range of 5-10 gigahertz. The method of FIG. 5 also includes enclosing (516) the conductive shield and the first and second inner conductors with a non-conductive layer.

In the method of FIG. 5, the first and second inner conductors may be substantially the same length. In such an embodiment providing (502) the first and second inner conductors may include aligning (508) corresponding ends of the first and second inner conductors and wrapping (504) a conductive shield may include wrapping (510) a number of conductive shields around the first and second inner conductors. Wrapping a number of conductive shields around the first and second inner conductors may include overlapping each of the conductive shields along and about the longitudinal axis, where the overlap of the conductive shields is aligned with the low current plane and where the conductive shields are wrapped along the first and second inner conductors iteratively beginning at one end of the first and second inner conductors and ending at the other end of the first and second inner conductors.

Also in the method of FIG. 5, providing (502) a first a second inner conductor may include providing (512) a drain conductor substantially parallel to the first and second inner conductors, wrapping (504) the conductive shield around the first and second inner conductors also includes wrapping (514) the conductive shield around the first and second inner conductors and the drain conductor, and enclosing (516) the conductive shield and the first and second inner conductors with a non-conductive layer may include enclosing (516) the first and second inner conductors and the drain conductor with the non-conductive layer. In the method of FIG. 1, the conductive shield may be made of aluminum foil, gold, copper, or any other conductive shield material as will occur to readers of skill in the art.

In the method of FIG. 5, providing (512) a drain conductor substantially parallel to the first and second inner conductors, wrapping (514) the conductive shield around the first and second inner conductors and the drain conductor, and enclosing (516) the first and second inner conductors and the drain conductor with the non-conductive layer is depicted as an optional method. That is, the steps of providing (512), wrapping (514), and enclosing (516) may be carried out in method of manufacturing a cable when that cable is provided a drain conductor. In the method of FIG. 5, for example, the of providing (512), wrapping (514), and enclosing (516) may be carried for embodiments of the method that include aligning (508) corresponding ends of the first and second inner conductors and wrapping a number of conductive shields around the inner conductors or the steps (512,514,516) may be carried out with a single conductive shield.

Figure 6:
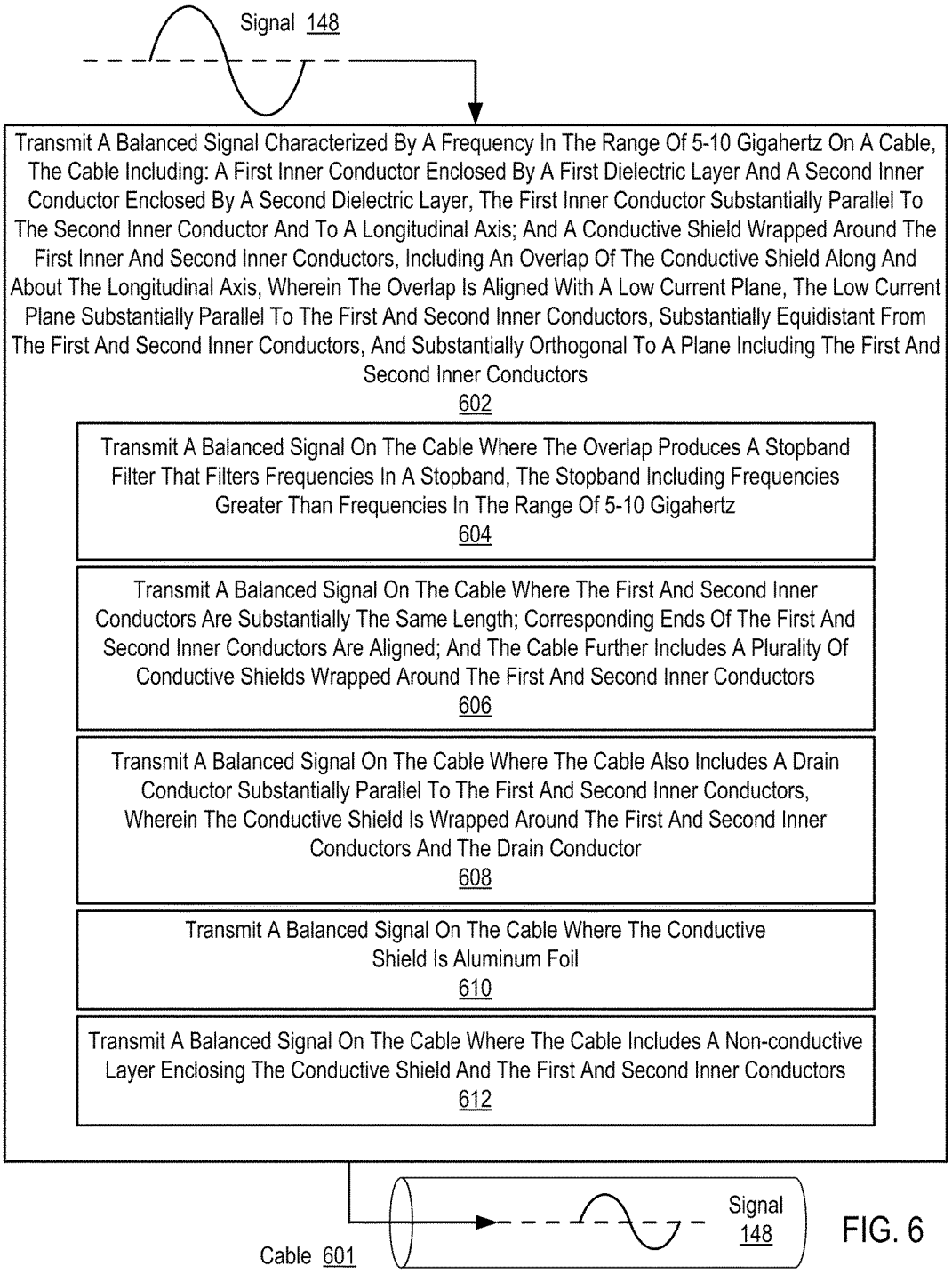
FIG. 6 sets forth a flow chart illustrating an exemplary method of transmitting a signal on a cable for high speed data communications according to embodiments of the present invention.

For further explanation FIG. 6 sets forth a flow chart illustrating an exemplary method of transmitting a signal on a cable (601) for high speed data communications according to embodiments of the present invention. The method of FIG. 6 includes transmitting (602) a balanced signal (148) characterized by a frequency in the range of 5-10 gigahertz on a cable (601). In the method of FIG. 6, the cable includes:

a first inner conductor enclosed by a first dielectric layer and a second inner conductor enclosed by a second dielectric layer, the first inner conductor substantially parallel to the second inner conductor and to a longitudinal axis; and a conductive shield wrapped around the first and second inner conductors, including an overlap of the conductive shield along and about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors.

In the method of FIG. 6, transmitting (602) a balanced signal may also include transmitting (604) the balanced signal where the overlap produces a stopband filter that filters frequencies in a stopband, the stopband including frequencies greater than frequencies in the range of 5-10 gigahertz. In the method of FIG. 6, transmitting (602) a balanced signal may also include transmitting (606) the balanced signal where the first and second inner conductors are substantially the same length, corresponding ends of the first and second inner conductors are aligned, and the cable also includes a plurality of conductive shields wrapped around the first and second inner conductors. Each of the conductive shields are overlapped along and about the longitudinal axis. The overlap of the conductive shields is aligned with the low current plane. The conductive shields are wrapped along the first and second inner conductors iteratively beginning at one end of the first and second inner conductors and ending at the other end of the first and second inner conductors.

In the method of FIG. 6, transmitting (602) a balanced signal may also include transmitting (608) the balanced signal where the cable (601) also includes a drain conductor substantially parallel to the first and second inner conductors, where the conductive shield is wrapped around the first and second inner conductors and the drain conductor. In the method of FIG. 6, transmitting (602) a balanced signal may also include transmitting (610) the balanced signal where the conductive shield is made of aluminum foil. In the method of FIG. 6, transmitting (602) a balanced signal may also include transmitting (612) the balanced signal where the cable (601) includes a non-conductive layer enclosing the conductive shield and the first and second inner conductors.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of manufacturing a cable for high speed data communications, the method comprising:

providing a first inner conductor enclosed by a first dielectric layer and a second inner conductor enclosed by a second dielectric layer, the first inner conductor substantially parallel to the second inner conductor and to a longitudinal axis; and wrapping a conductive shield around the first and second inner conductors, including overlapping the conductive shield along and only about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors, wherein for the length of the shield, within every plane that is perpendicular to the longitudinal axis of the overlap, the longitudinal axis of the first inner conductor, and the longitudinal axis of the second inner conductor: the center of the overlap is equidistance to the center of first inner conductor and the center of the second inner conductor, thereby tuning a stopband with the overlap to filter frequencies at a desired center frequency, wherein:

the first and second inner conductors are substantially the same length;

providing the first and second inner conductors further comprises aligning corresponding ends of the first and second inner conductors; and wrapping a conductive shield further comprises wrapping a plurality of conductive shields around the first and second inner conductors, including overlapping each of the conductive shields along and about the longitudinal axis, wherein the overlap of the conductive shields is aligned with the low current plane and wherein the conductive shields are wrapped along the first and second inner conductors iteratively beginning at one end of the first and second inner conductors and ending at the other end of the first and second inner conductors, and wherein the overlap produces a stopband filter that filters frequencies in a stopband, the stopband including frequencies greater than frequencies of signals to be transmitted along the first and second inner conductors and including frequencies greater than frequencies in the range of 5-10 gigahertz.

2. The method of claim 1 wherein:

providing the first and second inner conductors further comprises providing a drain conductor substantially parallel to the first and second inner conductors; and wrapping the conductive shield around the first and second inner conductors further comprises wrapping the conductive shield around the first and second inner conductors and the drain conductor.

3. The method of claim 1 wherein the conductive shield comprises aluminum foil.

4. The method of claim 1 further comprising:

enclosing the conductive shield and the first and second inner conductors with a non-conductive layer.

5. A cable for high speed data communications, the cable comprising:

a first inner conductor enclosed by a first dielectric layer and a second inner conductor enclosed by a second dielectric layer, the first inner conductor substantially parallel to the second inner conductor and to a longitudinal axis; and a conductive shield wrapped around the first and second inner conductors, including an overlap of the conductive shield along and only about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors, wherein for the length of the shield, within every plane that is perpendicular to the longitudinal axis of the overlap, the longitudinal axis of the first inner conductor, and the longitudinal axis of the second inner conductor: the center of the overlap is equidistance to the center of first inner conductor and the center of the second inner conductor, thereby tuning a stopband with the overlap to filter frequencies at a desired center frequency, wherein:

the first and second inner conductors are substantially the same length;

providing the first and second inner conductors further comprises aligning corresponding ends of the first and second inner conductors; and wrapping a conductive shield further comprises wrapping a plurality of conductive shields around the first and second inner conductors, including overlapping each of the conductive shields along and about the longitudinal axis, wherein the overlap of the conductive shields is aligned with the low current plane and wherein the conductive shields are wrapped along the first and second inner conductors iteratively beginning at one end of the first and second inner conductors and ending at the other end of the first and second inner conductors, and wherein the overlap produces a stopband filter that filters frequencies in a stopband, the stopband including frequencies greater than frequencies of signals to be transmitted along the first and second inner conductors and including frequencies greater than frequencies in the range of 5-10 gigahertz.

6. The cable of claim 5 further comprising a drain conductor substantially parallel to the first and second inner conductors, wherein the conductive shield is wrapped around the first and second inner conductors and the drain conductor.

7. The cable of claim 5 wherein the conductive shield comprises aluminum foil.

8. The cable of claim 5 further comprising a non-conductive layer enclosing the conductive shield and the first and second inner conductors.

9. A method of transmitting a signal on a cable for high speed data communications, the method comprising:

transmitting a balanced signal characterized by a frequency in the range of 5-10 gigahertz on a cable, the cable comprising:

a first inner conductor enclosed by a first dielectric layer and a second inner conductor enclosed by a second dielectric layer, the first inner conductor substantially parallel to the second inner conductor and to a longitudinal axis; and a conductive shield wrapped around the first and second inner conductors, including an overlap of the conductive shield along and only about the longitudinal axis, wherein the overlap is aligned with a low current plane, the low current plane substantially parallel to the first and second inner conductors, substantially equidistant from the first and second inner conductors, and substantially orthogonal to a plane including the first and second inner conductors, wherein for the length of the shield, within every plane that is perpendicular to the longitudinal axis of the overlap, the longitudinal axis of the first inner conductor, and the longitudinal axis of the second inner conductor: the center of the overlap is equidistance to the center of first inner conductor and the center of the second inner conductor, thereby tuning a stopband with the overlap to filter frequencies at a desired center frequency, wherein:

the first and second inner conductors are substantially the same length;

wherein corresponding ends of the first and second inner conductors are aligned; and wherein a plurality of conductive shields are wrapped around the first and second inner conductors such that each of the conductive shields is overwrapped along and about the longitudinal axis, wherein the overlap of the conductive shields is aligned with the low current plane and wherein the conductive shields are wrapped along the first and second inner conductors iteratively beginning at one end of the first and second inner conductors and ending at the other end of the first and second inner conductors, and wherein the overlap produces a stopband filter that filters frequencies in a stopband, the stopband including frequencies greater than frequencies of signals to be transmitted along the first and second inner conductors and including frequencies greater than frequencies in the range of 5-10 gigahertz.

10. The method of claim 9, wherein the cable further comprises a drain conductor substantially parallel to the first and second inner conductors, wherein the conductive shield is wrapped around the first and second inner conductors and the drain conductor.

11. The method of claim 9 wherein the conductive shield comprises aluminum foil.

12. The method of claim 9 wherein the cable further comprises a non-conductive layer enclosing the conductive shield and the first and second inner conductors.

* * * * *